US007267641B2

(12) United States Patent
Hsieh

(10) Patent No.: US 7,267,641 B2
(45) Date of Patent: Sep. 11, 2007

(54) MUSCLE TRAINING DEVICE

(75) Inventor: Chin-Hsun Hsieh, Nan-Tou Hsien (TW)

(73) Assignee: Strong Power Engineering Consultant Ltd. Co., Nan-Tou Hsien (TW)

( * ) Notice: Subject to any disclaimer, the term of this patent is extended or adjusted under 35 U.S.C. 154(b) by 0 days.

(21) Appl. No.: 11/236,807

(22) Filed: Sep. 28, 2005

(65) Prior Publication Data

US 2007/0072751 A1 Mar. 29, 2007

(51) Int. Cl.
*A63B 21/008* (2006.01)
*A63B 21/02* (2006.01)

(52) U.S. Cl. ..... 482/111; 482/112; 482/126; 482/908

(58) Field of Classification Search ..... 482/111–113, 482/122, 128, 140, 72, 73, 908
See application file for complete search history.

(56) References Cited

U.S. PATENT DOCUMENTS

| | | | | | |
|---|---|---|---|---|---|
| 2,806,699 | A * | 9/1957 | Spooner | 482/126 |
| 3,174,343 | A * | 3/1965 | Kasulis | 482/112 |
| 3,861,677 | A * | 1/1975 | Wheeldon | 482/113 |
| 4,022,463 | A * | 5/1977 | Scott, Jr. | 482/122 |
| 4,185,818 | A * | 1/1980 | Brentham | 482/112 |
| 4,632,393 | A * | 12/1986 | Van Noord | 482/133 |
| 4,645,205 | A * | 2/1987 | Wolff | 482/139 |
| 4,722,016 | A * | 1/1988 | Shirako et al. | 360/128 |
| 4,981,199 | A * | 1/1991 | Tsai | 188/312 |
| 6,053,851 | A * | 4/2000 | Tu | 482/122 |
| 6,733,426 | B2 * | 5/2004 | Bussell | 482/112 |
| 2005/0054499 | A1 * | 3/2005 | Davies, III | 482/131 |

FOREIGN PATENT DOCUMENTS

TW 182143 4/1992

OTHER PUBLICATIONS

Taiwanese Patent Publication No. 182143 dated Apr. 11, 1992.

* cited by examiner

*Primary Examiner*—Stephen R. Crow
*Assistant Examiner*—Allana Lewin
(74) *Attorney, Agent, or Firm*—Harness, Dickey & Pierce, P.L.C.

(57) ABSTRACT

A muscle training device includes a base seat, a first support arm connected pivotally to the base seat, a second support arm connected pivotally to an impeding unit, and two supporting cushions connected respectively to the support arms. The impeding unit has a housing fixed to the first support arm, a piston unit, first and second fluid chambers formed on two opposite sides of the piston unit, a fluid filled in the first and second fluid chambers, and a passage unit that is in fluid communication with the first and second fluid chambers. The second support arm is turnable toward or away from the first support arm.

7 Claims, 8 Drawing Sheets

MUSCLE TRAINING DEVICE

BACKGROUND OF THE INVENTION

1. Field of the Invention

The invention relates to an exercising device, more particularly to a muscle training device.

2. Description of the Related Art

Referring to FIG. 1, a conventional leg exercising device 100 includes a pair of vertically extending slide rails 101 assembled within a generally vertical frame 1, and a stack of weights 102 through which the slide rails 101 are inserted. The vertical frame 1 has top and bottom support bars 2, 3 extending forwardly and respectively from central top and bottom ends thereof. The bottom support bar 3 has a front end connected with a seat frame 4. The top support bar 2 has a front end connected with a front support bar 5 which extends downwardly and inclinedly therefrom and which has a bottom end connected to the seat frame 4. A backrest member 501 and a seat member 401 are respectively connected to a middle section of the front support bar 5 and a top portion of the seat frame 4. The seat frame 4 is provided with a pair of support tubes 402 below the seat member 401. The support tubes 402 of the seat frame 4 are sleeved respectively onto axial rods 403, which in turn are connected respectively with rotary discs 404 at top ends thereof. The rotary discs 404 are fixed respectively with support rods 405, each projecting outwardly from a top face of the respective rotary disc 404. The support rod 405 of each rotary disc 404 is connected with a knee support 406 and an upright pad 407. The axial rods 403 are fixed respectively with sector-shaped cams 408 at bottom ends thereof. The sector-shaped cams 408 are connected respectively with a belt 6 that wraps around the sector-shaped cams 408. The belt 6 is connected to a pulley unit 301 which is connected pivotally to the bottom support bar 3, another pulley unit 103 mounted on the top end of the vertical frame 1, and the stack of weights 102.

To use the conventional leg exercising device 100, a user sits on the seat member 401 with his/her back resting on the backrest 501 and his/her legs straddled over the respective knee supports 406. The legs of the user then push the upright pads 407 toward each other, urging the support rods 405, the rotary discs 404, the axial rods 403, and the sector-shaped cams 408 to rotate synchronously, thereby permitting the belt 6 to lift the stack of weights 102. The combined force applied by the user's legs at this time must be sufficient to lift the stack of weights 102 so as to achieve training of the user's leg muscles.

Although the conventional leg exercising device 100 can achieve its intended purpose, the structure of the conventional leg exercising device 100 is complicated and bulky. Furthermore, since the stack of weights 102 has a substantial weight, when the applied force of the user's legs is released so as to proceed with the next pressing movement, the stack of weights 102 is prone to quickly fall. If this occurs, the upright pads 407 are abruptly moved toward their original positions, which can easily injure the user's legs. Moreover, when the user desires to adjust the load to enhance training of the leg muscles, he/she has to move to the back of the exercising device 100 and manipulate the stack of weights 102 in a known manner. This is a troublesome process.

Referring to FIG. 2, a conventional muscle training device 200 is disclosed in Taiwanese Publication No. 182143. The muscle training device 200 includes two press arms 7 connected pivotally to each other, a torsion spring 8 attached to the junction of the press arms 7 to restore the press arms 7 to their original positions, and a hydraulic cylinder 9 connected between the press arms 7 to control the resistance of the press arms 7. Free ends of the press arms 7 are placed between the user's legs, and are compressed toward each other so as to train the muscles of the user's legs. Since the conventional muscle training device 200 is clamped between the user's legs without any supporting structure, the muscle training device 200 easily falls to the floor during exercise, thereby making it cumbersome and even dangerous to use.

SUMMARY OF THE INVENTION

Therefore, the object of the present invention is to provide a muscle training device that has a simple construction, that is convenient to carry, and that can minimize sport's injuries.

According to one embodiment of this invention, a muscle training device comprises a base seat, a first support arm having a first end connected pivotally to the base seat, an impeding unit, a second. support arm having a first end connected pivotally to the impeding unit, and two supporting cushions connected respectively to the first and second support arms and disposed away from the impeding unit. The impeding unit has a housing fixed to the first support arm, a piston unit provided in the housing, first and second fluid chambers formed in the housing on two opposite sides of the piston unit, a fluid filled in the first and second fluid chambers, and a passage unit that is in fluid communication with the first and second fluid chambers. The second support arm is turnable toward or away from the first support arm.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
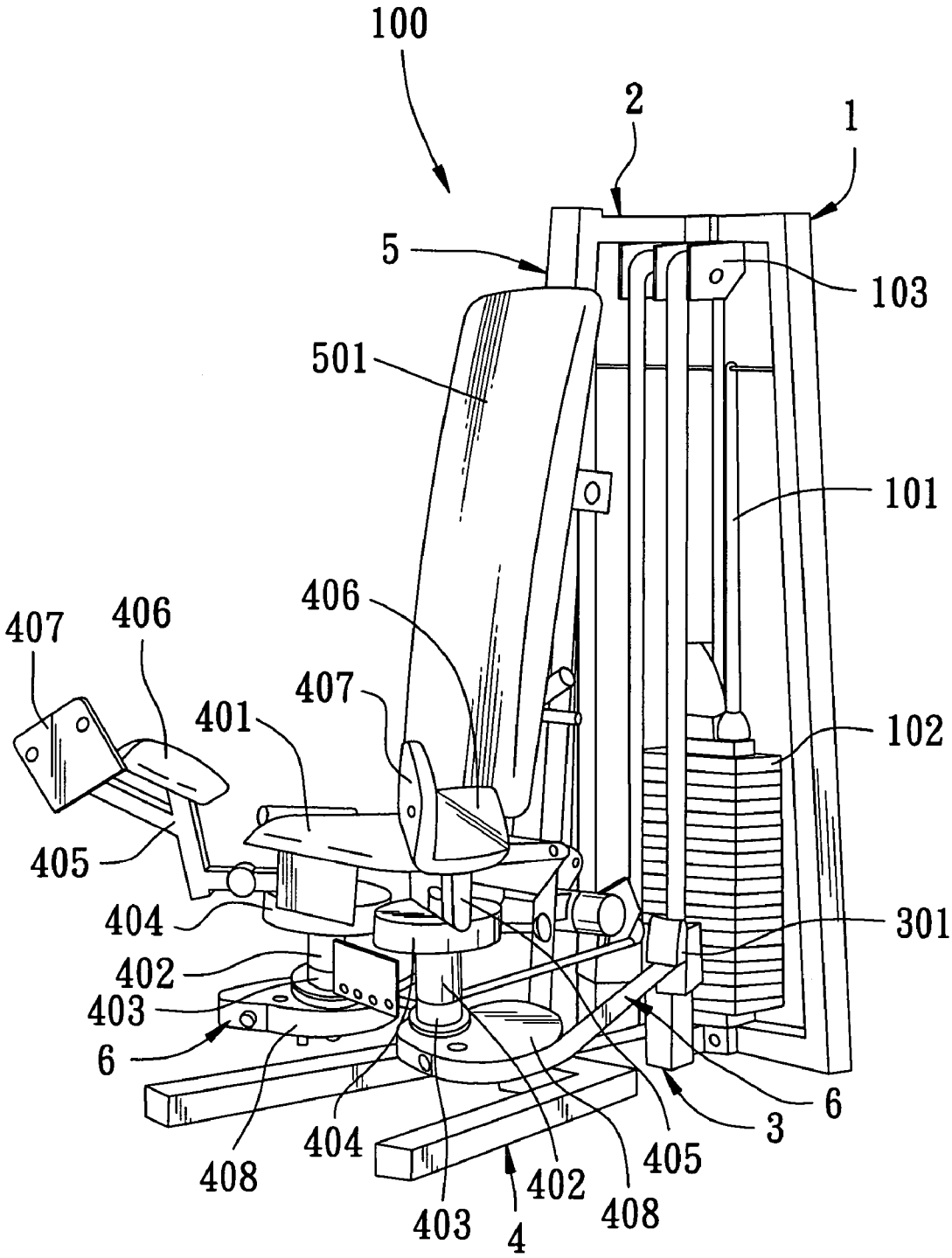
FIG. 1 PRIOR ART
FIG. 1 is a perspective view of a conventional leg exercising device.
Figure 2:
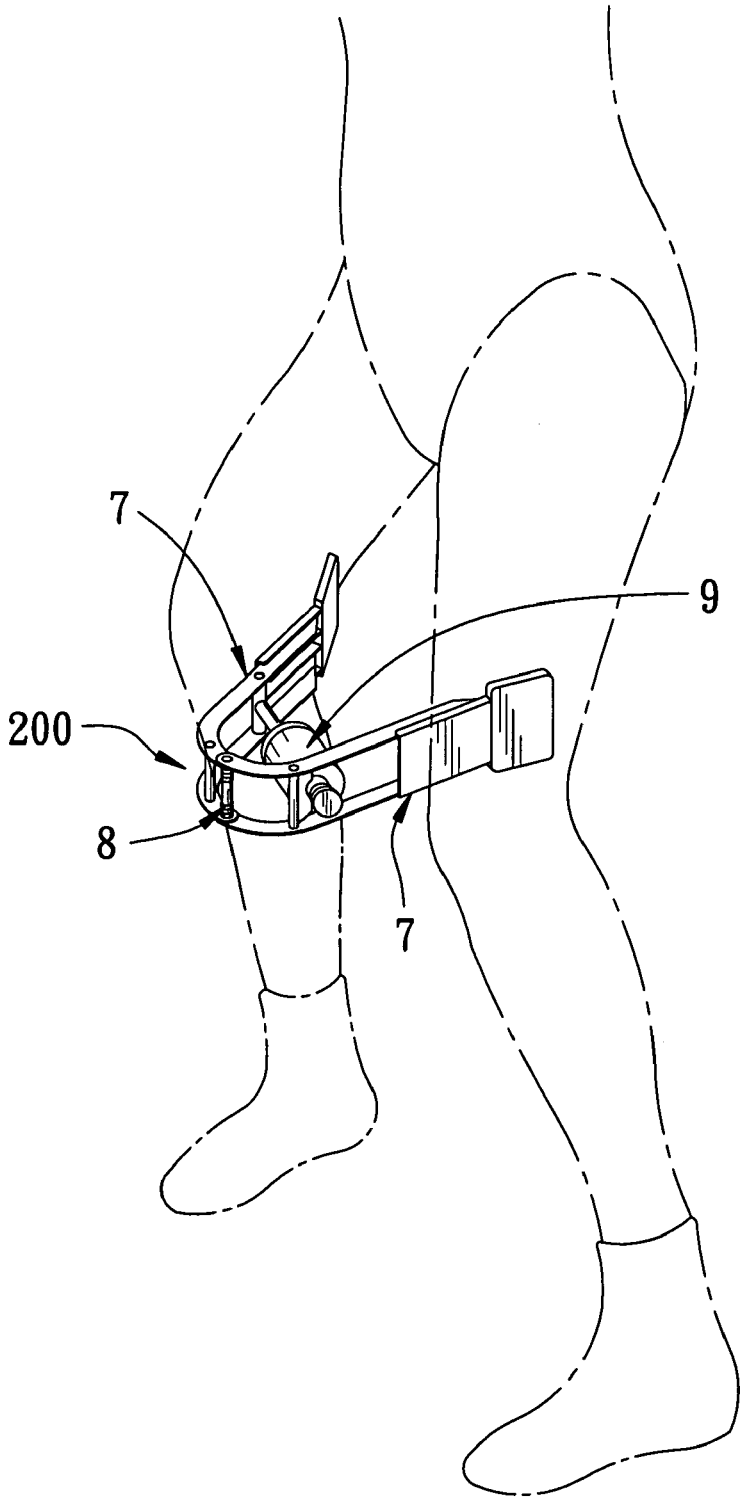
FIG. 2 PRIOR ART
FIG. 2 is a perspective view of a conventional muscle training device in a state of use.
Figure 3:
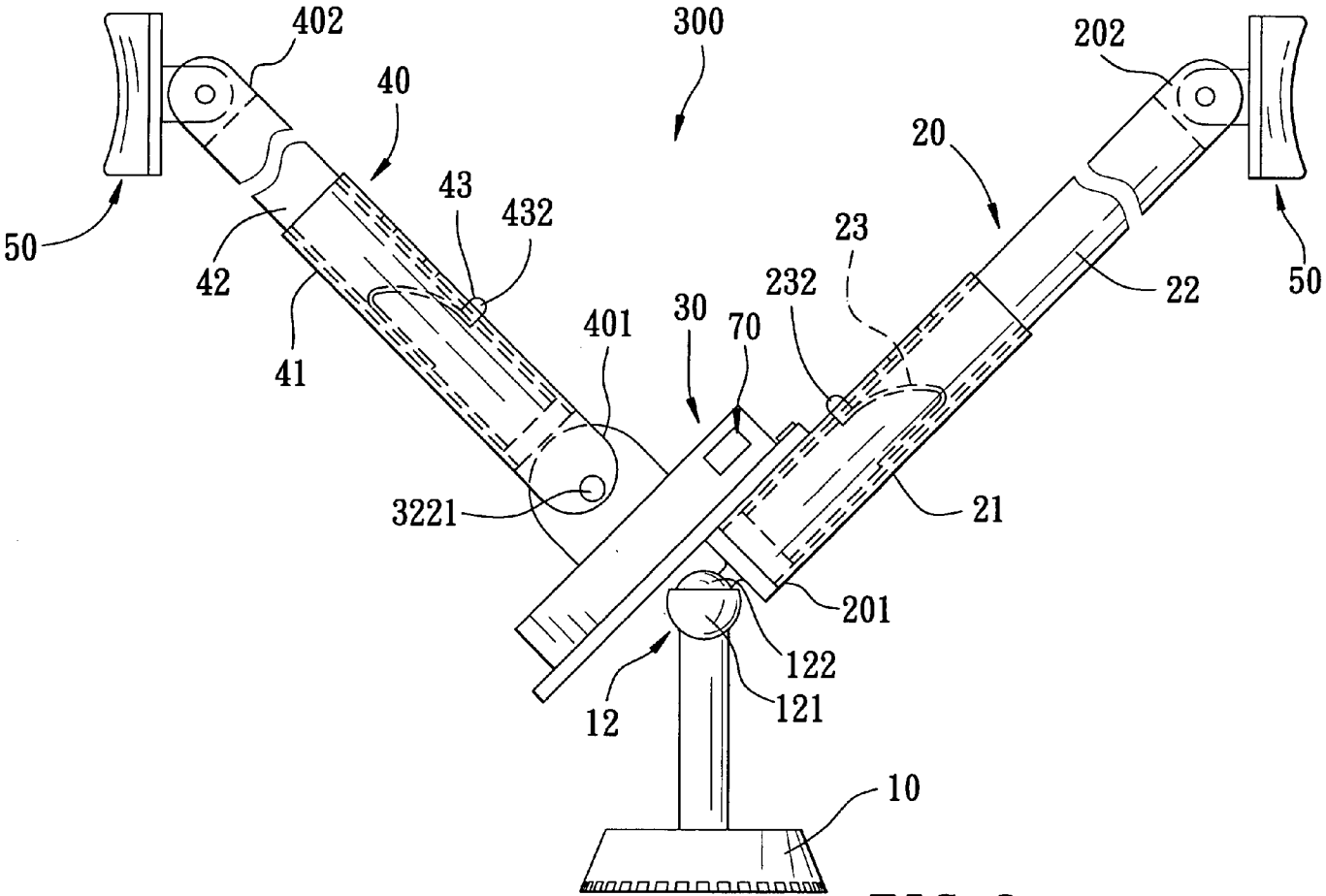
FIG. 3 is an elevation view of the first preferred embodiment of a muscle training device according to the present invention.
Figure 4:
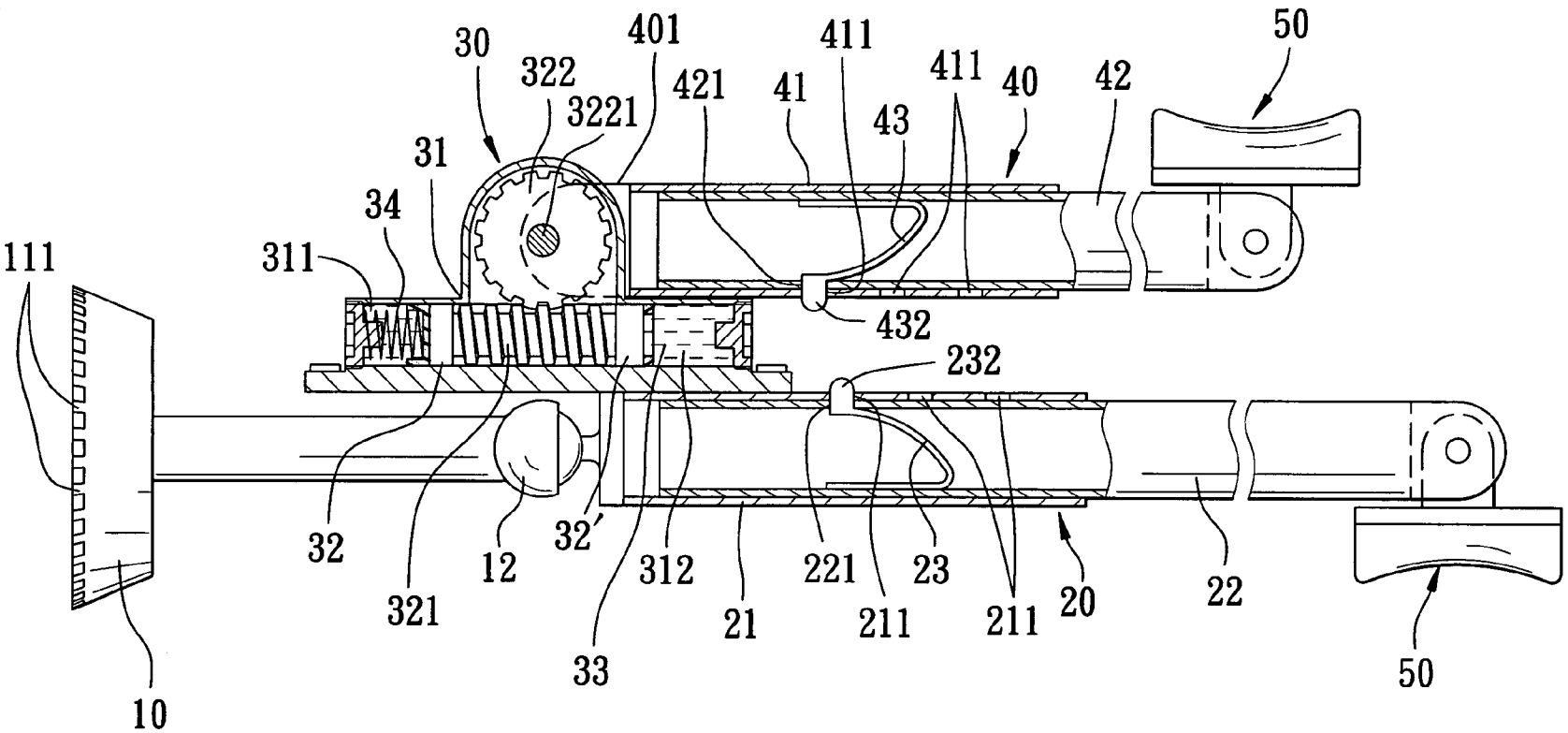
FIG. 4 is a partly sectional view of the first preferred embodiment in a folded state.

Before the present invention is described in greater detail, it should be noted that like elements are denoted by the same reference numerals throughout the disclosure.

Referring to FIGS. 3 to 6, the first preferred embodiment of a muscle training device 300 according to the present invention is shown to comprise a base seat 10, a universal joint 12, a first support arm 20, an impeding unit 30, a second support arm 40, and two supporting cushions 50.

The base seat 10, in this embodiment, is adapted to be mounted on the ground, and has a bottom face provided with a plurality of anti-slip projections 111.

The universal joint 12 includes a socket 121 fixed to the base seat 10, and a ball 122 received in the socket 121.

The first support arm 20 has a first end 201 fixed to the ball 122 so that the universal joint 12 is disposed between the base seat 10 and the first end 201 of the first support arm 20. The first support arm 20 includes an outer tube 21, an inner tube 22, and a resilient engaging member 23. The outer tube 21 is formed with a plurality of positioning holes 211. The inner tube 22 is telescopically connected to the outer tube 21, and is formed with a through hole 221 proximate to a bottom end thereof. The resilient engaging member 23 is disposed within the inner tube 22, and has a protrusion 232 extending through the through hole 221 in the inner tube 22, and out of a selected one of the positioning holes 211 in the outer tube 21 so as to immobilize the inner tube 22 relative to the outer tube 21. Hence, when the protrusion 232 is pressed into the corresponding positioning hole 211, the inner tube 22 can be pushed or pulled so as to move the protrusion 232 into another one of the positioning holes 211, thereby achieving length adjustment of the first support arm 20.

The impeding unit 30 has a housing 31, a piston unit, first and second fluid chambers 311, 312, a fluid 33, a spring 34, a first passage 35, and a second passage 36. The housing 31 is fixed to the outer tube 21 of the first support arm 20. The piston unit includes a pair of pistons 32, 32' and a worm rod 321. The pistons 32, 32' are disposed slidably and respectively in the first and second fluid chambers 311, 312. The worm rod 321 is disposed within the housing 31 between the first and second fluid chambers 311, 312, and has two opposite ends connected respectively to the pistons 32, 32'. The first and second fluid chambers 311, 312 are formed in the housing 31 on either side of the pistons 32, 32'. The fluid 33 used in this embodiment is oil, and is filled into first and second fluid chambers 311, 312. The spring 34 is disposed within the first fluid chamber 311 to bias the piston 32, and has one end connected to the housing 31 and the other end connected to the piston 32. The first passage 35 is in fluid communication with the first and second fluid chambers 311, 312, and is provided with a first one-way valve 351 and a first control valve 352. The first one-way valve 351 permits the fluid 33 to flow from the first fluid chamber 311 to the second fluid chamber 312. The first control valve 352 controls the flow rate of the fluid 33 through the first passage 35. The second passage 36 is also in fluid communication with the first and second fluid chambers 311, 312, and is provided with a second one-way valve 361 and a second control valve 362. The second one-way valve 361 permits the fluid 33 to flow from the second fluid chamber 312 to the first fluid chamber 311. The second control valve 362 controls the flow rate of the fluid 33 through the second passage 36.

The impeding unit 30 further has a worm gear 322 disposed within the housing 31 and meshing with the worm rod 321.

Figure 5:
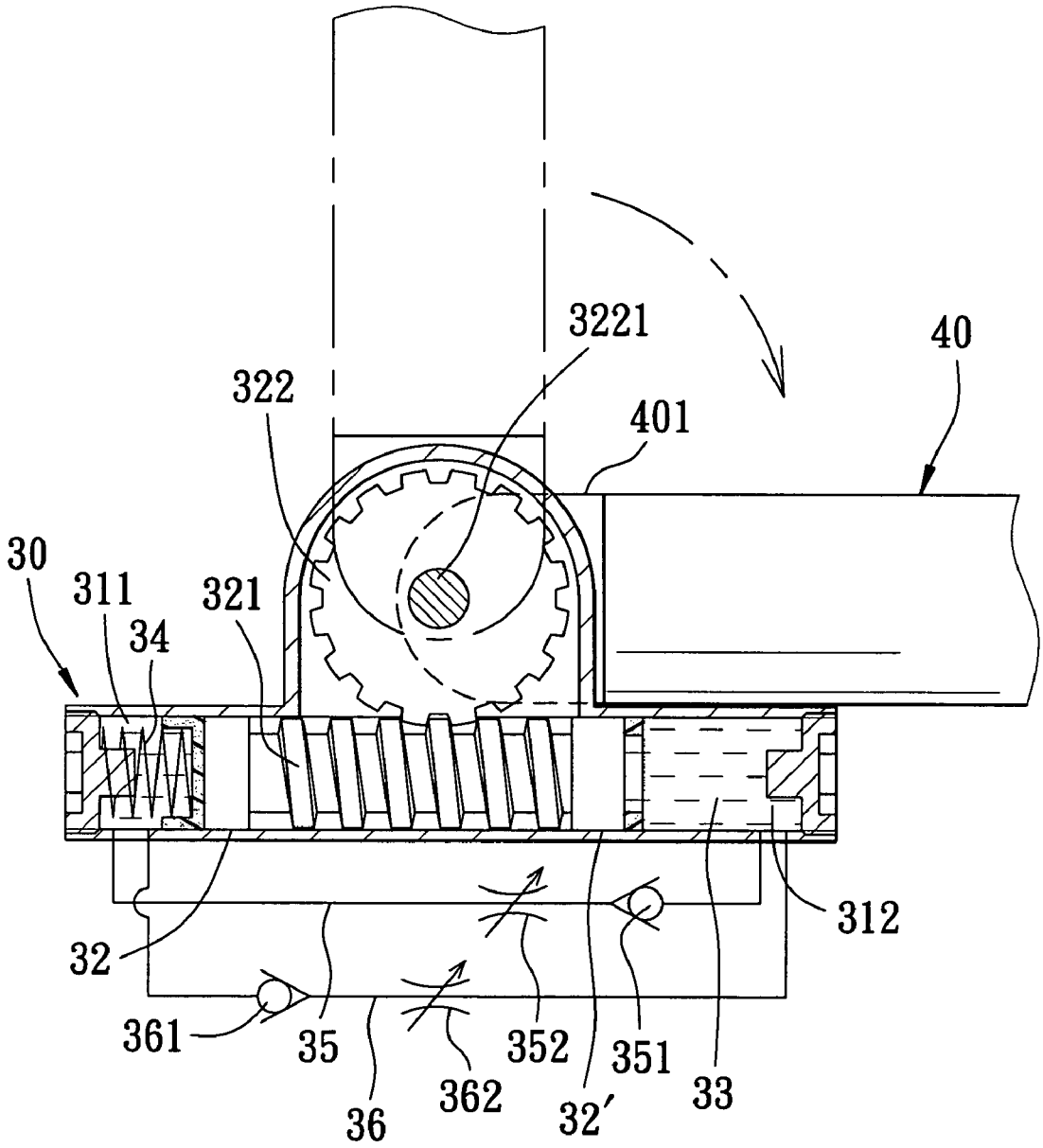
FIG. 5 is a fragmentary view of the first preferred embodiment, illustrating how a second arm support is moved to a folded state.

With reference to FIG. 5, when a force is applied to rotate the worm gear 322, the worm gear 322 moves the worm rod 321 so that the worm rod 321 pushes the piston 32 to compress the spring 34. This results in the flow of the fluid 33 from the first fluid chamber 311 into the second fluid chamber 312 through the first passage 35.

Figure 6:
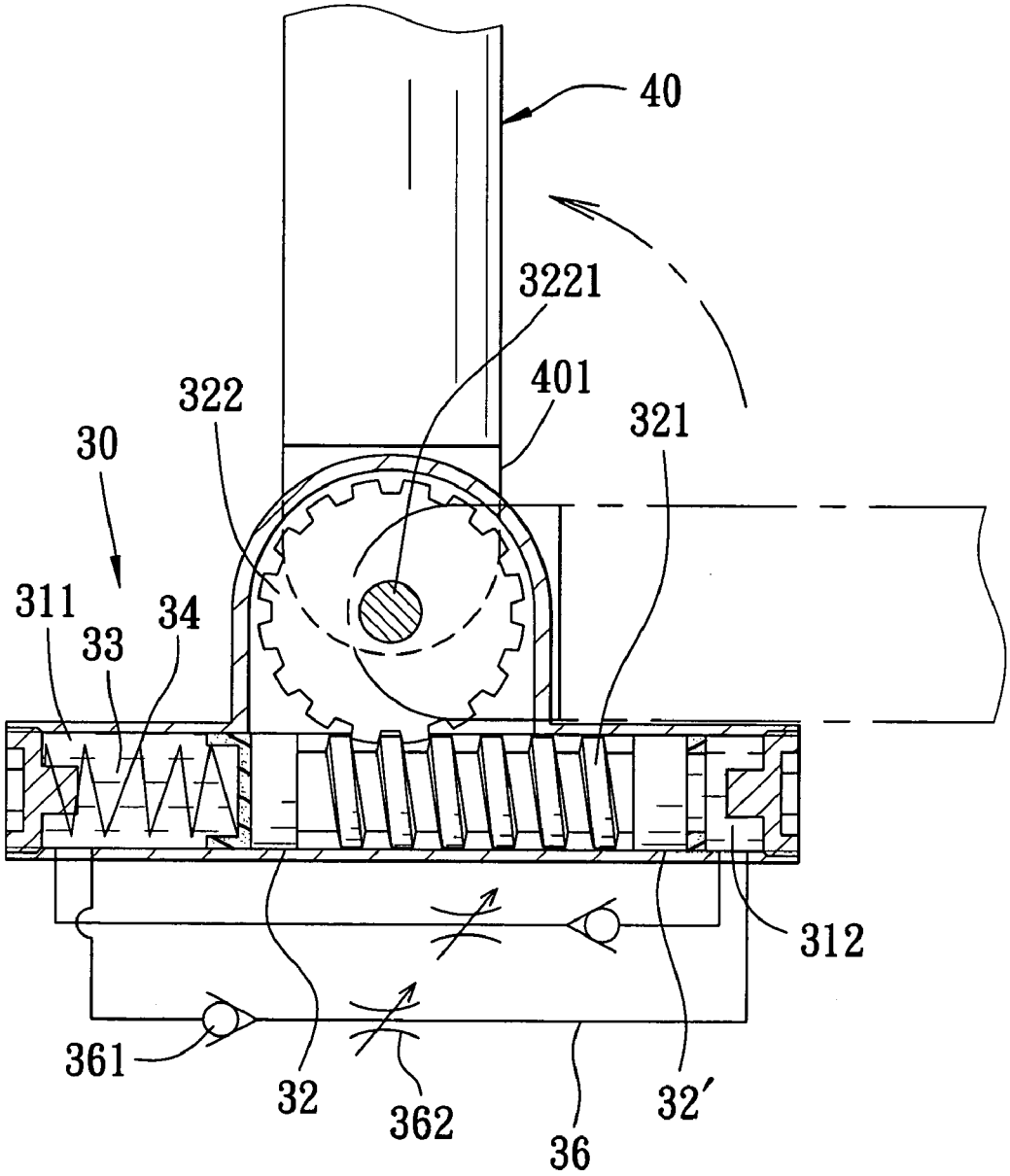
FIG. 6 is a view similar to FIG. 5, but illustrating how the second arm support is moved to its original position.

With reference to FIG. 6, when the applied force on the worm gear 322 is released, the worm rod 321 is restored to its original position through the biasing action of the spring 34, and the worm gear 322 is also restored to its original position through interaction with the worm rod 321. Simultaneously, the fluid 33 flows back from the second fluid chamber 312 to the first fluid chamber 311 through the second passage 36.

The second support arm 40 has a first end 401 fixed to a pivot shaft 3221 of the worm gear 322, and is movable toward or away from the first support arm 20. When the spring 34 is in a normal (non-compressed) state, as shown in FIG. 6, the second support arm 40 is moved away from the first support arm 20, and forms an angle relative to the first support arm 20. When the spring 34 is in a compressed state, as shown in FIG. 5, the second support arm 40 is moved toward the first support arm 20. The second support arm 40 is similar in construction to the first support arm 20. Particularly, the second support arm 40 has an outer tube 41, an inner tube 42, and a resilient engaging member 43. The outer tube 41 is formed with a plurality of positioning holes 411. The inner tube 42 is telescopically connected to the outer tube 41, and is formed with a through hole 421 proximate to a bottom end thereof. The resilient engaging member 43 is disposed within the inner tube 42, and has a protrusion 432 extending through the through hole 421 in the inner tube 42, and out of a selected one of the positioning holes 411 in the outer tube 41 so as to immobilize the inner tube 42 relative to the outer tube 41. When the protrusion 432 is pressed into the corresponding positioning hole 411, the inner tube 42 can be pushed or pulled so as to move the protrusion 432 into another one of the positioning holes 411, thereby achieving length adjustment of the second support arm 40.

The supporting cushions 50 are connected pivotally and respectively to second ends 202, 402 of the first and second support arms 20, 40 to support a user's legs, arms, etc.

Figure 7:
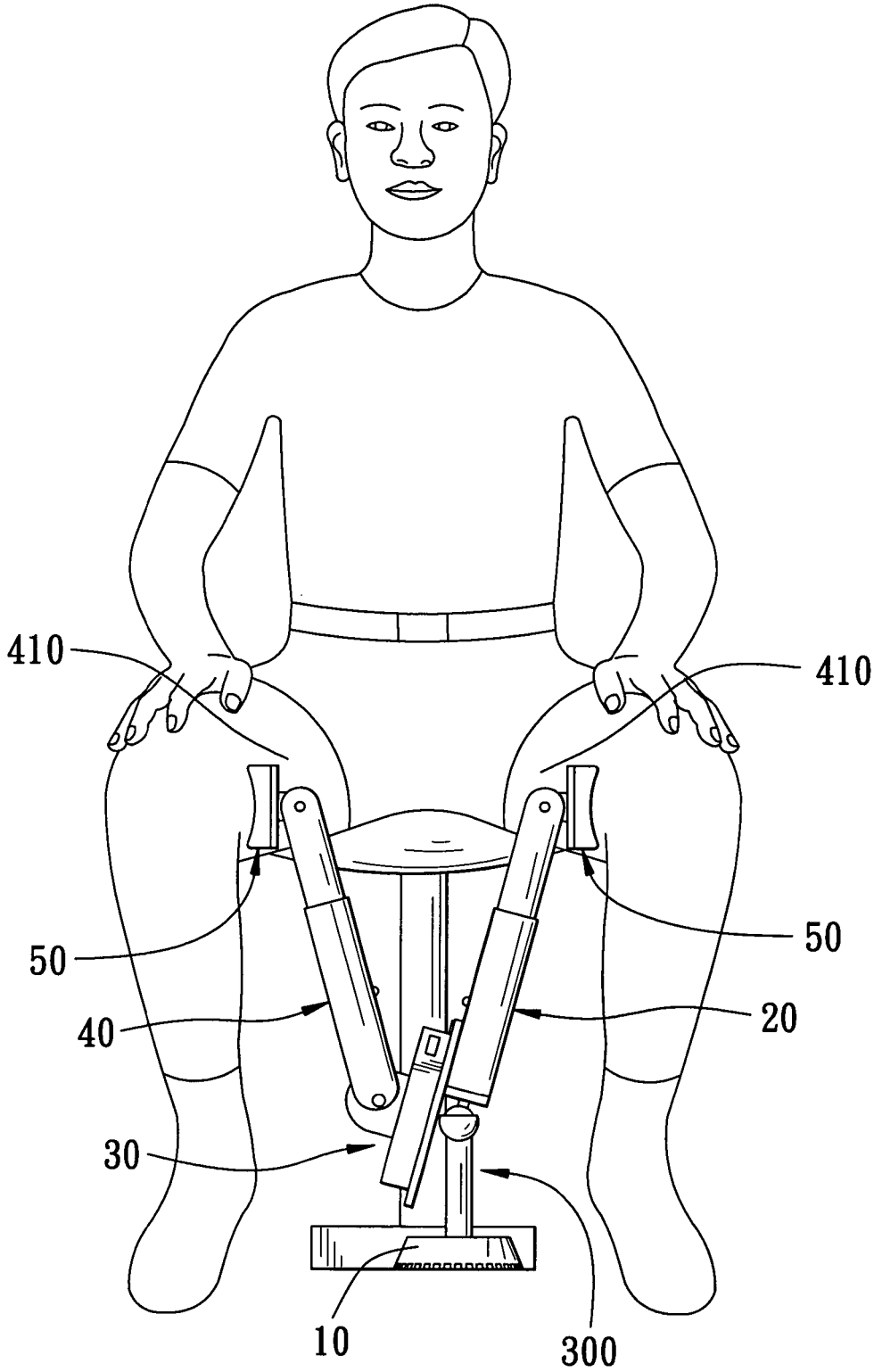
FIG. 7 illustrates use of the first preferred embodiment.

FIG. 7 illustrates use of the muscle training device 300 of the present invention. The base seat 10 is first placed on the ground, after which the lengths of the first and second support arms 20, 40 are adjusted to suit the length of the legs 410 of the user. The supporting cushions 50 are then disposed between and clamped by the legs 410 of the user. Moving the legs 410 toward and away from each other achieves the muscle training purpose of the present invention.

From the aforementioned description, it is apparent that the muscle training device 300 of the present invention has a simple structure consisting only of the base seat 10, the first and second support arms 20, 40, the impeding unit 30, and the supporting cushions 50. After assembly of these components, the resulting size is smaller than that of the conventional leg exercising device 100. An advantage of the simple structure is that the cost of the muscle training device 300 is minimized. The muscle training device 300 is also convenient to carry after being folded (e.g., through a locking mechanism that interlaces the first and second support arms 20, 40). Further, the base seat 10 of the present invention is adapted to be mounted on the ground, so that the muscle training device 300 is unlikely to be inadvertently removed from the user's legs during use. Through the restoring force of the spring 34 and through the resistance provided by the fluid 33, a dampening effect of the muscle training device 300 is achieved so that sudden outward movement of the support arms 20, 40 is impeded. Hence, when the user moves his/her legs away from each other, the first and second support arms 20, 40 will move slowly away from each other, thereby preventing muscle injuries. Moreover, by operating the first control valve 352, the size of opening in the first passage 35 is adjusted so as to control the flow rate of the fluid 33 through the first passage 35. The smaller the opening in the first passage 35, the lower will be the flow rate. Hence, a greater force has to be applied to effect movement of the first and second support arms 20, 40 toward each other. In contrast, when the opening is large, a lesser force is needed. Consequently, the amount of force that must be exerted by the user's legs during exercise can be controlled through the first control valve 352. In comparison with the conventional leg exercising device 100 in which such control is realized by adjusting the stack of weights 102, the present invention is much simpler and more convenient to use. Additionally, since the restoring force of the spring 34 is constant, by controlling the second control valve 362 in the second passage 36, the speed of restoration of the pistons 32, 32' can be adjusted as well.

The muscle training device 300 of the present invention may further comprise a counter 70 provided on the impeding unit 30 for detecting and recording the movement of the pistons 32, 32'. Hence, the user 400 may gauge his/her training progress.

Figure 8:
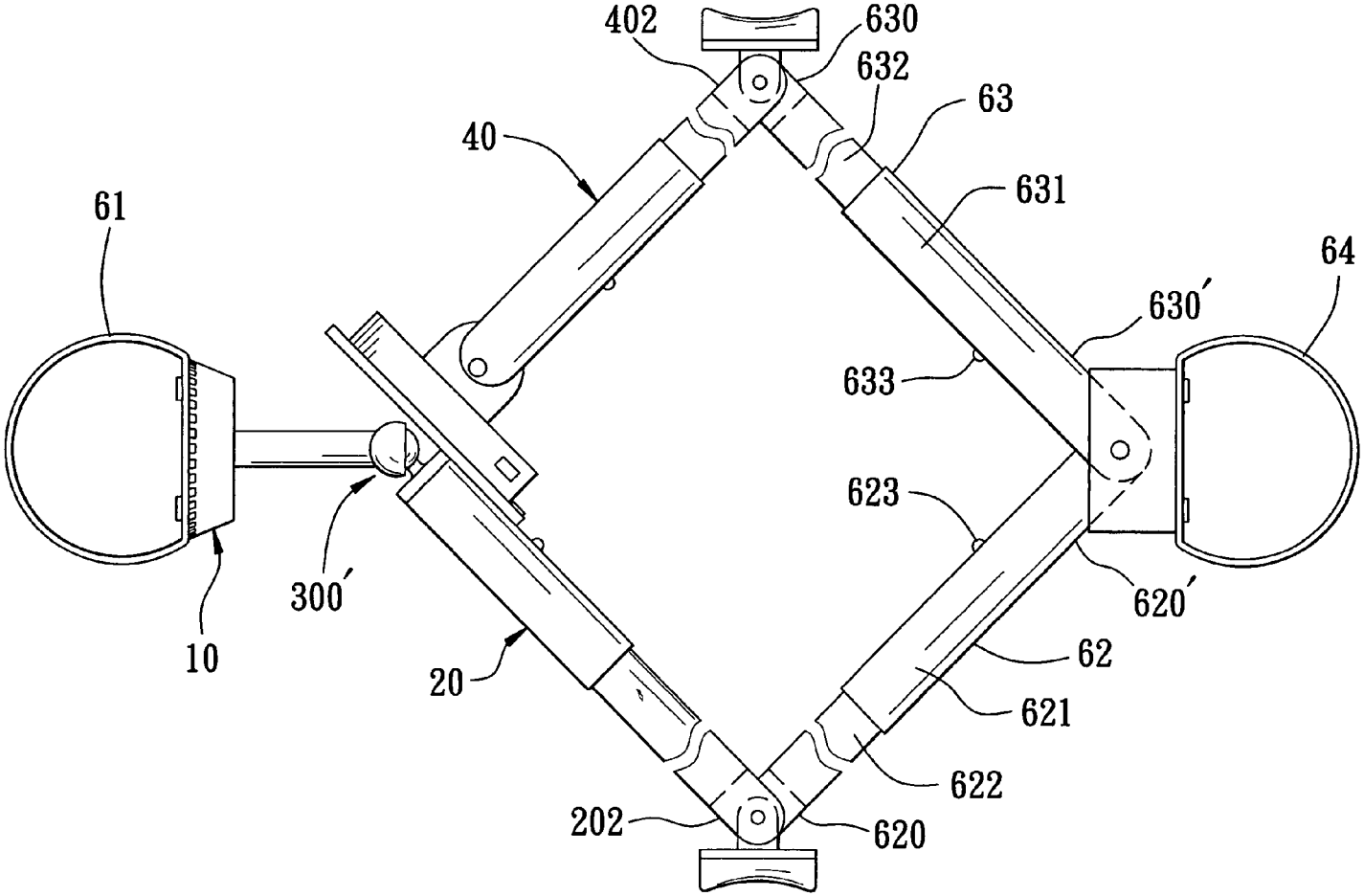
FIG. 8 is a top schematic view of the second preferred embodiment of a muscle training device according to the present invention.

Referring to FIG. 8, the second preferred embodiment of a muscle training device 300' according to the present invention is shown to be similar to the first preferred embodiment. However, in this embodiment, the muscle training device 300' comprises additionally a first pull ring 61 connected to the base seat 10, a third support arm 62 having a first end 620 connected pivotally to the second end 202 of the first support arm 20, a fourth support arm 63 having a first end 630 connected pivotally to the second end 402 of the second support arm 40 and a second end 630' connected pivotally to a second end 620' of the third support arm 62, and a second pull ring 64 connected to the second ends 620', 630' of the third and fourth support arms 62, 63. Each of the third and fourth support arms 62, 63 is telescopic, and includes an outer tube 621, 631, an inner tube 622, 632 connected telescopically to the outer tube 621, 631, and a resilient engaging member 623 for restricting movement of the inner tubes 622, 632 relative to the outer tubes 621, 631. In use, both legs or both hands of the user can be inserted respectively into the first and second pull rings 61, 64 to perform pulling exercises, thereby achieving training of muscles in different parts of the user's body.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A muscle training device comprising:

a base seat;

a first support arm having a first end connected pivotally to said base seat;

an impeding unit having a housing fixed to said first support arm, a piston unit provided in said housing, first and second fluid chambers formed in said housing on two opposite sides of said piston unit, said piston unit includes a pair of pistons which are disposed slidably and respectively in said first and second fluid chambers, a spring disposed within one of said first and second fluid chambers to bias said piston unit, a fluid filled in said first and second fluid chambers, and a passage unit that is in fluid communication with said first and second fluid chambers;

a second support arm having a first end connected pivotally to said impeding unit, and turnable toward or away from said first support arm;

the impeding unit further includes a worm rod disposed in said housing between said first and second fluid chambers and having two opposite ends connected respectively to said pistons, and a worm gear disposed within said housing and meshing with said worm rod, said worm gear having a pivot shaft, said first end of said second support arm being connected to said pivot shaft; and two supporting cushions connected respectively to said first and second support arms and disposed away from said impeding unit.

2. The muscle training device of claim 1, further comprising a universal joint connected between said base seat and said first end of said first support arm, said universal joint including a socket fixed to said base seat, and a ball fixed to said first end of said first support arm.

3. The muscle training device of claim 1, wherein each of said first and second support arms includes an outer tube having a plurality of positioning holes, an inner tube telescopically connected to said outer tube and having a through hole, and a resilient engaging member disposed in said inner tube and extending through said through hole and out of a selected one of said positioning holes so as to restrict movement of said inner tube relative to said outer tube.

4. The muscle training device of claim 1, wherein said passage unit includes a first passage and a second passage, said first passage having a first one-way valve to permit said fluid to flow from said first fluid chamber to said second fluid chamber, said second passage having a second one-way valve to permit said fluid to flow from said second fluid chamber to said first fluid chamber.

5. The muscle training device of claim 1, further comprising a counter connected to said impeding unit to detect and record movement of said piston unit.

6. A muscle training device comprising:

a base seat;

a first support arm having a first end connected pivotally to said base seat;

an impeding unit having a housing fixed to said first support arm, a piston unit provided in said housing, first and second fluid chambers formed in said housing on two opposite sides of said piston unit, a spring disposed within one of said first and second fluid chambers to bias said piston unit, a fluid filled in said first and second fluid chambers, and a passage unit that is in fluid communication with said first and second fluid chambers;

a second support arm having a first end connected pivotally to said impeding unit, and turnable toward or away from said first support arm;

two supporting cushions connected respectively to said first and second support arms and disposed away from said impeding unit; and a first pull ring connected to said base seat, a third support arm having a first end connected pivotally to said first support arm, a fourth support arm having a first end connected pivotally to said second support arm, and a second pull ring, said third and fourth support arms respectively having second ends which are connected pivotally to each other, said second pull ring being connected to said second ends of said third and fourth support arms.

7. The muscle training device of claim 6, wherein each of said third and fourth support arms is telescopic.

* * * * *